US005124903A

United States Patent [19]

Coviello

[11] Patent Number: 5,124,903

[45] Date of Patent: Jun. 23, 1992

[54] DECORATIVE LIGHT DISPLAY UNIT

[76] Inventor: Debra S. Coviello, 1823 Canterbury Rd., Hampton, Va. 23666

[21] Appl. No.: 779,976

[22] Filed: Oct. 21, 1991

[51] Int. Cl.[5] ..... F21P 1/02

[52] U.S. Cl. ..... 362/392; 362/224; 362/209; 362/249; 362/810

[58] Field of Search ..... 362/209, 224, 240, 244, 362/249, 362, 392, 810, 806

[56] References Cited

U.S. PATENT DOCUMENTS 1,707,539 4/1929 Propp .
1,976,964 10/1934 Propp ..... 362/810 X
2,658,168 11/1953 Matson .
3,681,588 8/1972 Lee .
3,684,882 8/1972 Mininno et al. .
3,806,723 4/1974 Ollom .

*Primary Examiner*—Stephen F. Husar
*Attorney, Agent, or Firm*—Wallace J. Nelson

[57] ABSTRACT

A decorative light display unit for displaying one or more lights for a window display, table centerpiece, or the like, wherein a substantially rectangular hollow housing is provided with a top surface having at least one transverse opening therethrough to maintain a display candle extending from each opening. A glass or plastic sconce is disposed around each candle and supported by a groove formed around the transverse opening. The sconce includes a first tubular end supported by the hollow housing and a flared bulbous open portion disposed around the bulb of the candle. The flared bulbous portion is provided with a scalloped tip end and a ribbon secured around a reduced diameter portion thereof. A hinged closure door is provided for one end of the hollow housing to permit the insertion/removal of a suitable candelabrum therein. A notch is provided in the closure door to accommodate an electric cord supplying electric current to the candelabrum. Alternate embodiments provide (1) a hinged connection for the top surface and (2) a tongue and groove sliding arrangement.

12 Claims, 2 Drawing Sheets

DECORATIVE LIGHT DISPLAY UNIT

FIELD OF THE INVENTION

This invention relates generally to decorative display devices and relates specifically to a decorative unit for displaying one or more lights of a window display, table centerpiece, or the like.

BACKGROUND OF THE INVENTION

Single electrical candles or multiple candle sets are frequently employed during the Christmas Holiday season to decorate some or all of the windows in a house. The candles presently employed are usually constructed of light weight plastics and frequently are unsteady and/or require additional support to maintain their position on the window sill. Candles are also frequently employed alone or in combination with floral arrangements as table centerpieces during the entire year but more frequently during holiday seasons. The present invention is directed to a decorative unit for supporting and displaying one or more candles or lights for a window display, table centerpiece, or the like, in an attractive and stable setting. The term "candle" as used herein is intended to include conventional wax candles but is primarily intended to define elongated or tapered electrical lights that simulate wax candles.

It is an object of the present invention to provide a decorative unit for displaying one or more candle lights for use as a window display, table centerpiece, or the like.

Another object of the present invention is a decorative unit that may be employed as a stable centerpiece or as a window display for one or more electric candles.

SUMMARY OF THE INVENTION

According to the present invention the foregoing and additional objects are attained by providing a hollow substantially rectangular housing unit having an open end, a closed end, a top surface, a bottom surface and two side surfaces. A closure door is provided for the open end and is hingedly connected to the two sides, or to the top and bottom surfaces, to permit selective movement between an open and a closed position for providing access to the interior of the hollow housing. The top surface in the preferred embodiment is removable and is provided with three openings transversely therethrough to permit the insertion of candle lights therein. Each opening is provided with a stepped circumferential recess therearound to support a specially designed decorative glass or clear plastic sconce. The top surface is also provided with a peripheral flange to fit over offset edge surfaces of the two sides and the closed end portion, and over the closure door for the open end. The closure door is hingedly connected to the two sides and is provided with a notch at the base thereof for the cord that supplies electrical current to the candle light fixture.

In one embodiment of the invention, the top surface is provided with a tongue extension along each of its linear side surfaces to slidably mate within a groove provided in each of the respective sides of the housing.

In another embodiment of the invention, the top surface is hingedly connected to one of the side surfaces to permit easy access to the housing interior for insertion/-withdrawal of the candle selection.

In each embodiment the top surface selected may be provided with one, two, three, five, or any other standard number of equal or diverse size openings to accommodate separate, individual electric candles, or conventional electric light candelabra.

BRIEF DESCRIPTION OF THE DRAWINGS

A more complete appreciation of the invention and many of the attendant advantages thereof will be more readily apparent as the same same becomes better understood by reference to the following detailed description when considered in connection with the accompanying drawings wherein.

DETAILED DESCRIPTION

Figure 1:
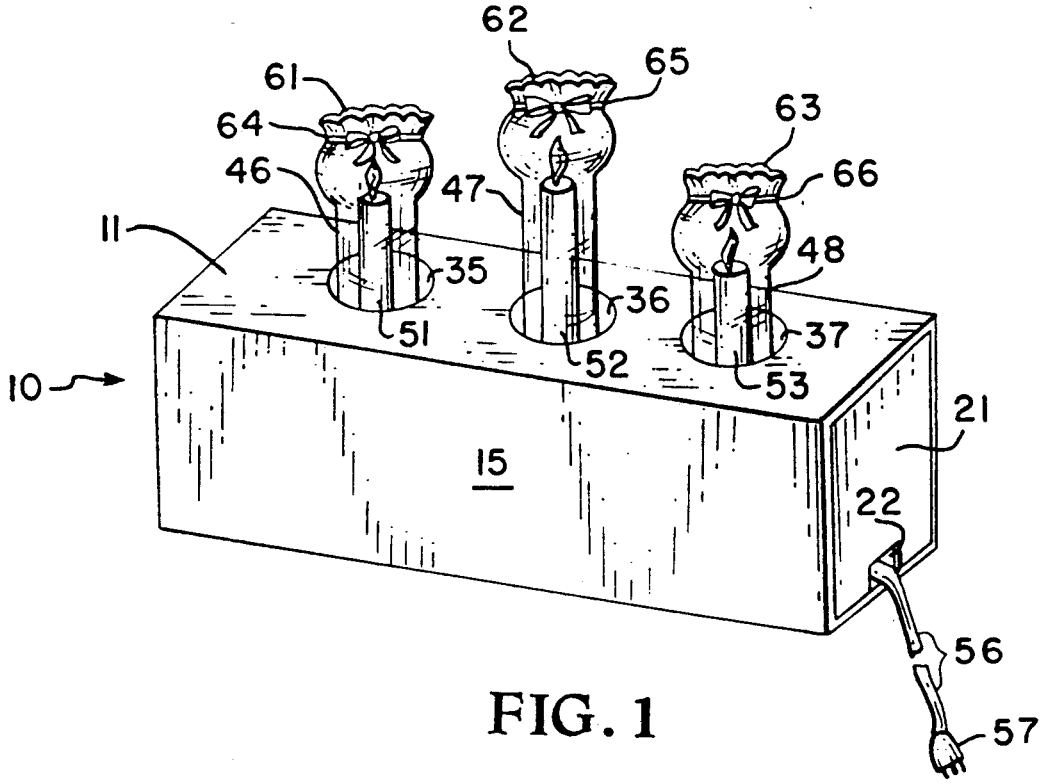
FIG. 1 is a perspective view of the preferred embodiment of the decorative light display unit of the present invention.
Figure 2:
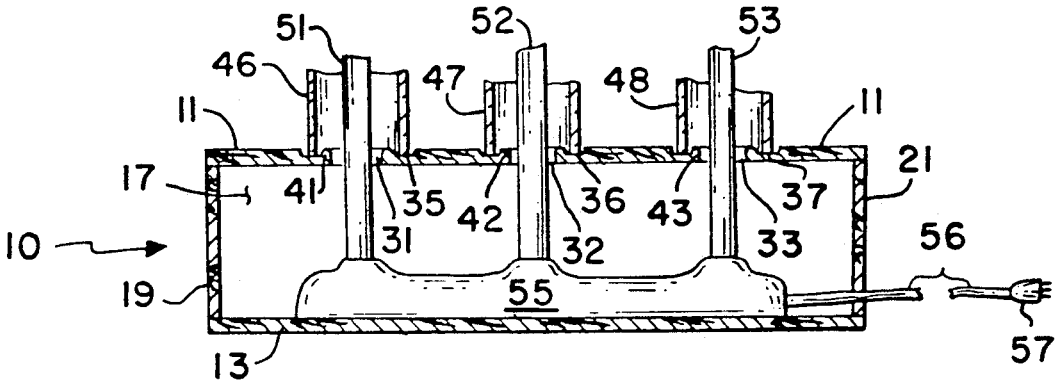
FIG. 2 is a part schematic, part sectional, view of the decorative light display unit shown in FIG. 1.

Referring now to the drawings and more particularly to FIGS. 1 and 2 the decorative light display unit or housing of the present invention is shown and designated generally by reference numeral 10. Decorative housing unit 10, as shown, is of a substantially rectangular configuration and provided with a top surface 11, a bottom surface 13 and two side surfaces 15,17. One end of housing unit 10 is closed via end closure 19 and the other end is open and selectively closed by closure door 21, having a notch 22 therein, as will be further explained hereinafter.

In the preferred illustrated embodiment, top surface 11 is provided with three transverse openings therethrough, as designated by reference numerals 31,32,33 (FIG. 2). A circumferentially disposed groove is provided around and slightly spaced from the periphery of each through opening 31,32,33 and designated, respectively, by reference numerals 35,36,37. The spacing between through openings 31,32,33 and the respective grooves 35,36,37 therearound forms a bead surface with these beaded surfaces being designated, respectively, by reference numerals 41,42,43. Three sconces 46,47,48 are disposed over beaded surfaces 41,42,43 and rest, respectively, in grooves 35,36,37.

Sconces 46,47,48 are formed of suitable glass or clear plastic and disposed, respectively, around individual candle lights 51,52,53 and consist of an elongated tubular end resting in respective grooves 35,36,37 and an enlarged bulbous end disposed around the light bulb of respective candle lights 51,52,53. The enlarged bulbous end of each sconce 46,47,48 terminates in a flared opening provided with scalloped tip ends, designated respectively by reference numerals 61,62,63, and having a ribbon tied around a reduced diameter portion of the bulbous end adjacent the scalloped tip ends. The ribbons for scalloped tip ends 61,62,63, are designated, respectively by reference numerals 64,65,66. In the illustrated embodiment, sconces 46 and 48 are of equal length, while sconce 47 is slightly longer to accommodate the longer length of candle light 52.

In most candle light fixtures, candle lights 51,52,53 are fixed or molded into candle fixture or candelabrum 55 as a single unit. In some fixtures, candles 51,51 and 53 are threadingly received in the base of a candle fixture or candelabrum 55 received within hollow decorative housing unit 11, as will be further explained hereinafter. A suitable lead wire 56 extends from candle fixture 55 through notch 22 for connection via plug 57 to a suitable electrical current source (not shown), in a conventional manner.

Figure 3:
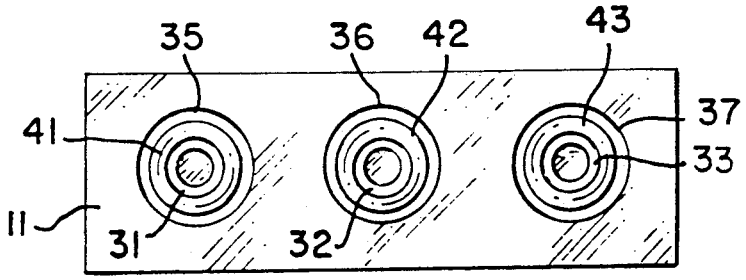
FIG. 3 is a top plan view of the top surface for the decorative light display unit shown in FIGS. 1 and 2.

Referring now to FIG. 3, a top plan view of top surface 11 is shown and illustrating the top view of through openings 31,32,33, the spaced grooves 35,36,37 and the beaded surfaces 41,42 and 43.

Figure 3A:
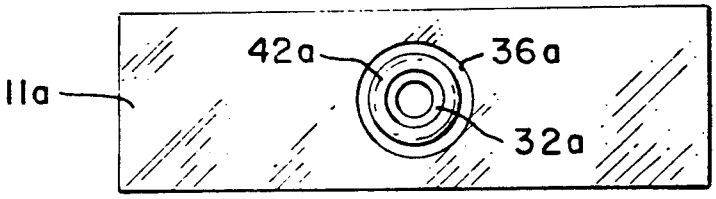
FIG. 3*a* is a view similar to FIG. 3 and illustrating an alternate top surface embodiment for the present invention.

FIG. 3*a* is a top plan view of an alternate top surface 11*a* designed for a decorative unit for displaying only one candle therein. As shown, top surface 11*a* is provided with one transverse through opening 32*a* having a spaced peripheral groove 36*a* therearound to form a beaded surface 42*a* and to support a suitable sconce (not shown).

Figure 4:
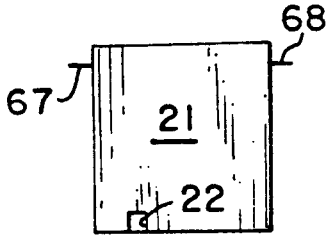
FIG. 4 is a view of a closure door for the decorative light display unit shown in FIGS. 1 and 2 and illustrating one location for the hinge connections thereof.

Referring now to FIG. 4, closure door 21 is provided with oppositely disposed hinge pins 67,68 extending from the side portions thereof and adjacent the door end opposite to notch 22. Hinge pins 67,68 are positioned in suitable openings (not illustrated) provided in side surfaces 15 and 17 and adjacent to top surface 11 to hingedly attach closure door 21 to housing unit 10.

Figure 5:
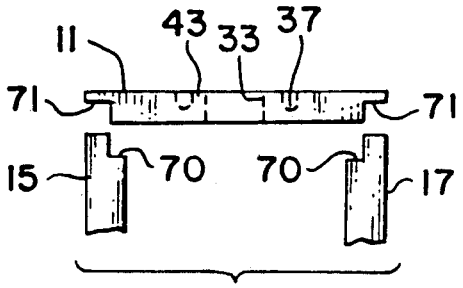
FIG. 5 is a partial end view of the decorative light display unit shown in FIGS. 1 and 2 and illustrating one structural connection for the top surface thereof.
Figure 6:
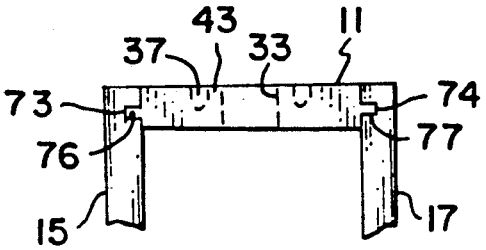
FIG. 6 is a partial end view similar to FIG. 5 and illustrating an alternate structural connection for the top surface.

Referring now to FIGS. 5 and 6 two embodiments of top surface 11 are shown. In the preferred embodiment of FIG. 5, and that shown in FIGS. 1 and 2, top surface 11 is received within offset or stepped portions 70 provided in the mating surfaces of sides 15,17 (and end closure 19, not visible in this FIG.). A peripheral flange 71 on the stepped periphery of top surface 11 extends over sides 15,17, end closure 19 and closure door 21 when top closure 11 is in the closed position.

In the alternate embodiment of FIG. 6, top surface 11 is provided with a tongue extension 73,74 on the respective longitudinal edges thereof that slidably engage grooves 76,77 provided along the respective inside surfaces of sides 15,17.

In each of the embodiments of FIGS. 5 and 6, the end view illustrated is taken from the end having through opening 33 therein with opening 33, peripheral groove 37, and beaded surface 43 being shown in dotted line.

Figure 7:
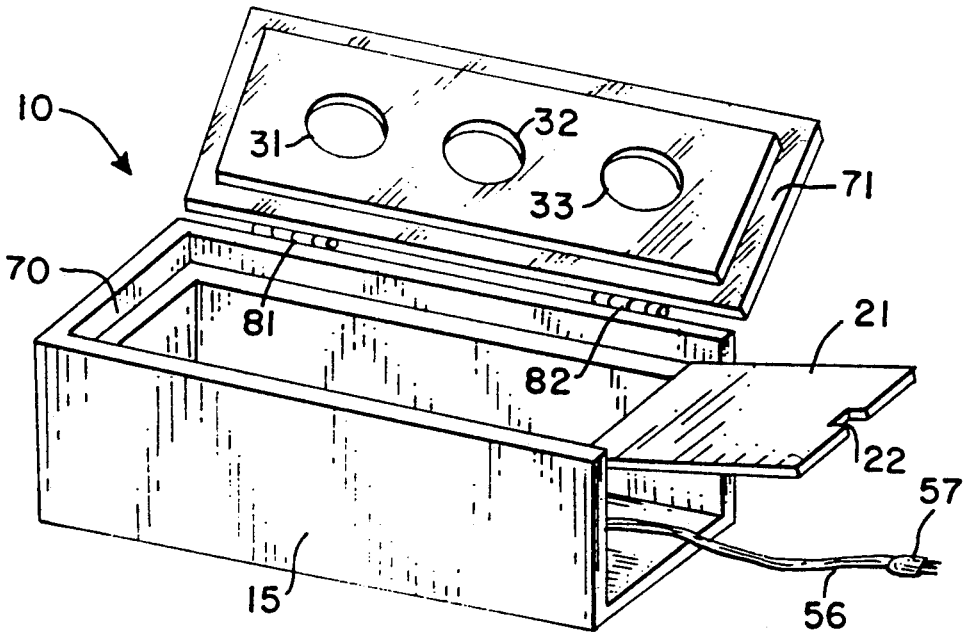
FIG. 7 is a perspective view, similar to FIG. 1, showing the bottom view of the top structure and illustrating another alternate top surface connection for the decorative light display unit of the present invention.

In the alternate embodiment shown in FIG. 7, top surface 11 is shown in the open position and is provided with a pair of hinges 81,82 releasably connecting top surface 11 to decorative unit 10.

In operation, or assembly of the component parts, candles 51,52,53 and attached fixture 55 are positioned within hollow housing unit 10 while top surface 11 is removed therefrom (FIGS. 1-3). Electric cord 56 and the attached plug 57, provided on fixture 55, are extended through the open end of housing 10. Top surface 11 is then slipped over candles 51,52,53 to close housing unit 10. Upon closure of closure door 21, electric cord 56 is received within notch 22 provided thereon and plug 57 is exposed for connection with a suitable source of electric current. When not in use, the excess length of electric cord 56 is pushed into, and stored within, hollow housing 10. Sconces 46,47,48 are then placed over respective candles 51,52,53 and received within respective grooves 35,36,37. Unit 10 is then ready to be positioned on a window sill, or the like, with candles 51,52,53 being illuminated upon connection of plug 47 to a suitable electric outlet.

In assembly of the embodiment of FIG. 6, fixture 55 cannot be integral with candles 51,52,53 and must be provided with removable candles. In this embodiment, the candles employed are threadingly removed from fixture 55 prior to placing the fixture through the open end of housing 10 provided for closure door 21. After insertion of fixture 55 in housing 10, closure door 21 is closed with electric cord 56 extending through notch 22, as in the previously described embodiment. The threaded candles are then inserted through the transverse openings in top surface 11 and received in the sockets in fixture 55. The decorative sconces are then positioned around the candles, as described hereinbefore in reference to the embodiment of FIGS. 1-2.

In the embodiment illustrated in FIG. 7, the exposed ends of candles 51,52,53 are inserted through respective openings 31,32,33 of top surface 11 with attached fixture 55 coming to rest against the inside portion of top surface 11. Cord 56 and plug 57 are positioned through the open end of housing 10 while closure door is in the open position shown in this FIG. While holding fixture 55 against the inside portion of top surface 11, the top surface is rotated about hinges 81,82 to close the top of housing 10. This closure of top surface 11 positions fixture 55 within housing 10 and leaves candles 51,52,53 extending therefrom. Closure door 21 is then closed to leave cord 56 extending through notch 22 as shown in FIG. 1. The decorative sconces are also employed in this embodiment as in the previously described embodiments.

No specific dimensions or materials have been mentioned for constructing display unit 10. In a specific example, housing unit 10 was constructed from one-half inch valsa wood and had a height of two and one-quarter inches, a width of two inches and a length of nine inches. The balsa wood was decorated by painting the entire exposed surfaces white. In another example, the balsa wood unit 10 was constructed, as described, and hand painted to produce a Christmas scene on one side surface, a poinsettia arrangement on the other side, and the end surfaces painted white. Obviously, this decoration may be custom designed for the user, or the occasion, and could include staining, the use of scrolled initials, stenciling, or the like. Also, the dimensions chosen in this specific embodiment were for a three light candelabrum but could be used with a single candle by using the top surface illustrated in FIG. 3*a*. Also, a single or pair of candles may be used with the top surface illustrated in FIG. 3 with the excess hole(s) therein being suitably plugged, covered, or employed to display a flower, flag, pennant, or other ornamentation. In lieu of the electrical candles, conventional wax candles may be employed in housing 10 for a window or table centerpiece decoration.

In lieu of the balsa wood construction, plywood, solid wood, polyvinylchloride, or other suitable plastic materials, may be employed to construct housing 10. Suitable decorative surfaces may be formed or molded with the plastics or may be painted, scrolled or stenciled thereon, as so desired.

Thus, although the invention has been described relative to specific embodiments thereof, it is not so limited and there are numerous variations and modifications of the invention that will be readily apparent to those skilled in the art in the light of the above teachings.

It is therefore to be understood that, within the scope of the appended claims, the invention may be practiced other than as specifically described herein.

What is claimed as new and desired to be secured by Letters Patent of the United States is:

1. A decorative unit for displaying one or more lights for a window display, table centerpiece, or the like,. comprising:

a substantially rectangular hollow housing;

said hollow housing having an open end, a closed end, a top surface, a bottom surface and two side surfaces;

a closure door for said open end hingedly connected to said side surfaces and selectively movable from an open to a closed position to provide access to the interior of said hollow housing;

said top surface being provided with at least one through opening therein; and said top surface having a circumferentially disposed groove spaced from the periphery of said at least one through opening therein so as form a bead therearound.

2. The decorative unit of claim 1 including a decorative surface provided on each of said two sides of said housing; said decorative surface being selected from the group of decorative surfaces consisting of staining, painting, carvings, scrolled with initials or other lettering, and stenciling.

3. The decorative unit of claim 1 including an electric candle fixture having a base portion and a plurality of vertically extending electrical candles disposed in linear spaced relationship on said base portion;

said at least one through opening in said top surface comprising a number of through openings equal in number to said plurality of candles on said base of said candle fixture;

each of said plurality of candles having an elongated body portion extending from said base portion of said candle fixture and terminating in an electric light bulb section;

an electric cord connectible to an electric current source and extending from said electric candle fixture through said closure door to supply electrical current to said electric candles; and said closure door being provided with a notch therein to permit the passage therethrough of said electric cord.

4. The decorative unit of claim 1 wherein said top surface is provided with a stepped periphery and includes a peripheral flange, each of said sides and said closed end being provided with a stepped or offset surface facing said top surface and said stepped periphery of said top surface mating with the stepped or offset surfaces of said sides and said closed end when said top surface is positioned to close the top of said hollow housing.

5. The decorative unit of claim 4 wherein said top surface is removable from said hollow housing to facilitate insertion/removal of an electric candle fixture within said hollow housing, and including a peripheral flange on said top surface that extends over said sides, said closed end and said open end of said hollow housing when in positioned to close the top of said hollow housing.

6. The decorative unit of claim 5 including at least a pair of hinges for hingedly connecting said top surface to one of said sides of said hollow housing to permit opening and closing of the top of said housing.

7. The decorative unit of claim 5 including said top surface being provided with a tongue extension on the longitudinal edges thereof and each of said sides being provided with a groove on a surface thereof to slidably receive said tongue extensions on said top surface for closure of said hollow housing.

8. The decorative unit of claim 1 including a decorative vertically extending sconce removable disposed within said circumferentially disposed groove around each of said at least one through opening.

9. The decorative unit of claim 8 including each said sconce being formed of a material selected from the group of materials consisting of glass and plastics and each of said sconces having a first open tubular section at one end thereof and a second open end extending from said first open tubular section and provided with an enlarged flared open end.

10. The decorative unit of claim 8 wherein each said sconce is formed of a material selected from the group of materials consisting of glass and plastics;

each said sconce being provided with a first open end adjacent a flared section;

said flared section extending over a minor portion of the length of said sconce;

each said sconce further having a reduced diameter tubular section extending from said flared section and extending over the major portion of the length of said sconce;

said reduced diameter tubular section terminating in a second open end; and said second open end being disposed over said bead formed around one of said through openings in said top surface.

11. The decorative unit of claim 8 wherein each said sconce is provided with a first open end disposed within one of said circumferentially disposed grooves;

each said sconce having a tubular section vertically extending from said first open end and merging with a flared section forming a second open end for each said sconce; and said flared open end being disposed around said electric light bulb section of one of said candles.

12. The decorative unit of claim 11 wherein said flared section of each said sconce is provided with a reduced diameter portion adjacent said second open end;

said second open end being provided with scalloped tip portions; and a decorative ribbon secured within said reduced diameter portion of each said sconce.

* * * * *